United States Patent [19]

Balinski

[11] Patent Number: 4,586,305

[45] Date of Patent: May 6, 1986

[54] CLIP FOR USE WITH RUNNER AND AREA SEPARATION WALL STRUCTURE UTILIZING CLIP

[75] Inventor: Henry A. Balinski, Hoffman Estates, Ill.

[73] Assignee: United States Gypsum Company, Chicago, Ill.

[21] Appl. No.: 596,029

[22] Filed: Apr. 2, 1984

[51] Int. Cl.[4] ..... E04B 2/84

[52] U.S. Cl. ..... 52/241; 52/303

[58] Field of Search ..... 52/241, 238.1, 533, 52/220, 221, 259, 285, 303

[56] References Cited

U.S. PATENT DOCUMENTS

| | | | |
|---|---|---|---|
| 1,924,986 | 8/1933 | Frazier | 52/241 |
| 1,999,741 | 4/1935 | Schultz | 52/259 |
| 2,020,502 | 11/1935 | Goddard | 52/238.1 |
| 2,105,588 | 1/1938 | Davis | 52/285 |
| 2,241,704 | 5/1941 | Goldsmith | 52/241 |
| 2,261,077 | 10/1941 | Schultz | 52/221 |
| 2,540,305 | 2/1951 | Tomlinson | 52/220 |
| 2,659,323 | 11/1953 | Alvarez | 52/533 |
| 2,909,251 | 10/1959 | Nelsson | 52/238.1 |
| 2,958,982 | 11/1960 | Baker | 52/481 |
| 3,107,454 | 10/1963 | Voegeli | 52/533 |
| 3,744,199 | 7/1973 | Navarre | 52/241 |
| 3,830,027 | 8/1933 | Paisley | 52/241 |
| 4,327,528 | 5/1982 | Fritz | 52/533 |

FOREIGN PATENT DOCUMENTS

| | | | |
|---|---|---|---|
| 973324 | 8/1975 | Canada | 52/241 |
| 2384075 | 3/1977 | France | 52/241 |

*Primary Examiner*—John E. Murtagh

*Attorney, Agent, or Firm*—Samuel Kurlandsky; Robert M. Didrick; Robert H. Robinson

[57] ABSTRACT

An integral clip for use in combination with a lower channel-form runner for securing and supporting a pair of spaced-apart wallboard panels in a demountable structure, the clip having flanges for engaging and being supported upon the edges of the flanges of the runner, and having a platform for supporting the lower edges of the wallboard panels in a position spaced above the bottom of the runner to prevent absorption of water and formation of mildew at the edges of the wallboard panels.

4 Claims, 4 Drawing Figures

CLIP FOR USE WITH RUNNER AND AREA SEPARATION WALL STRUCTURE UTILIZING CLIP

BACKGROUND OF THE INVENTION

1. Field of the Invention

The present invention relates to building construction, and more particularly concerns clips for use in combination with lower runners to support parallel spaced-apart wallboards in a position wherein their lower edges are spaced above the bottom of the runner to prevent water absorption and mildew.

2. Description of the Prior Art

In the assembly of wall panels to construct a wall, and particularly an area separation wall, it is conventional to provide elongate channel members, called runners for retaining the edges of the panels. The runners are secured to the floor and ceiling, thereby fixing the position of the wall with respect thereto. Such runners may have a variety of shapes, but more generally have a channel-form shape, and invariably require an inner panel supporting surface for each panel. In the construction of area separation walls two rows of wallboard are required. The runners may be manufactured in a variety of ways and form a variety of materials. One of the least expensive fabrication means is to roll-form metal strips into the desired channel shape.

Area separation walls are typically installed prior to complete enclosure of the building. The wallboard panels are therefore exposed to all the common elements. During a rain water collects in the runner track and at low spots on the concrete floor. This water is absorbed at the edges of the gypsum liner panels, eventually causing delamination of the paper and the formation of mildew.

SUMMARY OF THE INVENTION

It is an object of the invention to provide a clip for use with a runner for securing and supporting a wall formed of a plurality of wall panels such as gypsum wallboard panels or other wall panel, such as cement board panels.

It is a further object of the invention to provide a runner and clip combination wherein the clip mounts on and is supported at the edges of the flanges of the runner, and wherein the clip has an integral platform for supporting the lower edges of panels such as gypsum wallboard panels above the lower portion of the lower runner to prevent the panels from absorbing water and forming mildew.

It is still further an object of the invention to provide a structure of the type described which is inexpensive and relatively easy to fabricate and assemble.

Other objects of the invention will become apparent from reference to the following description and accompanying drawings.

According to the invention, a channel-form lower runner is provided with an integral clip having means for engaging and being supported upon the upper edges of the flanges of the runner, the clip having a supporting platform spaced above the bottom of the runner for supporting the lower edges of gypsum wallboard panels to prevent their being immersed in water which may collect at the bottom of the runner, thereby preventing the deterioration of the paper cover sheets due to water absorption and preventing the formation of mildew.

DEsCRIPTION OF THE PREFERRED EMBODIMENTS

Figure 1:
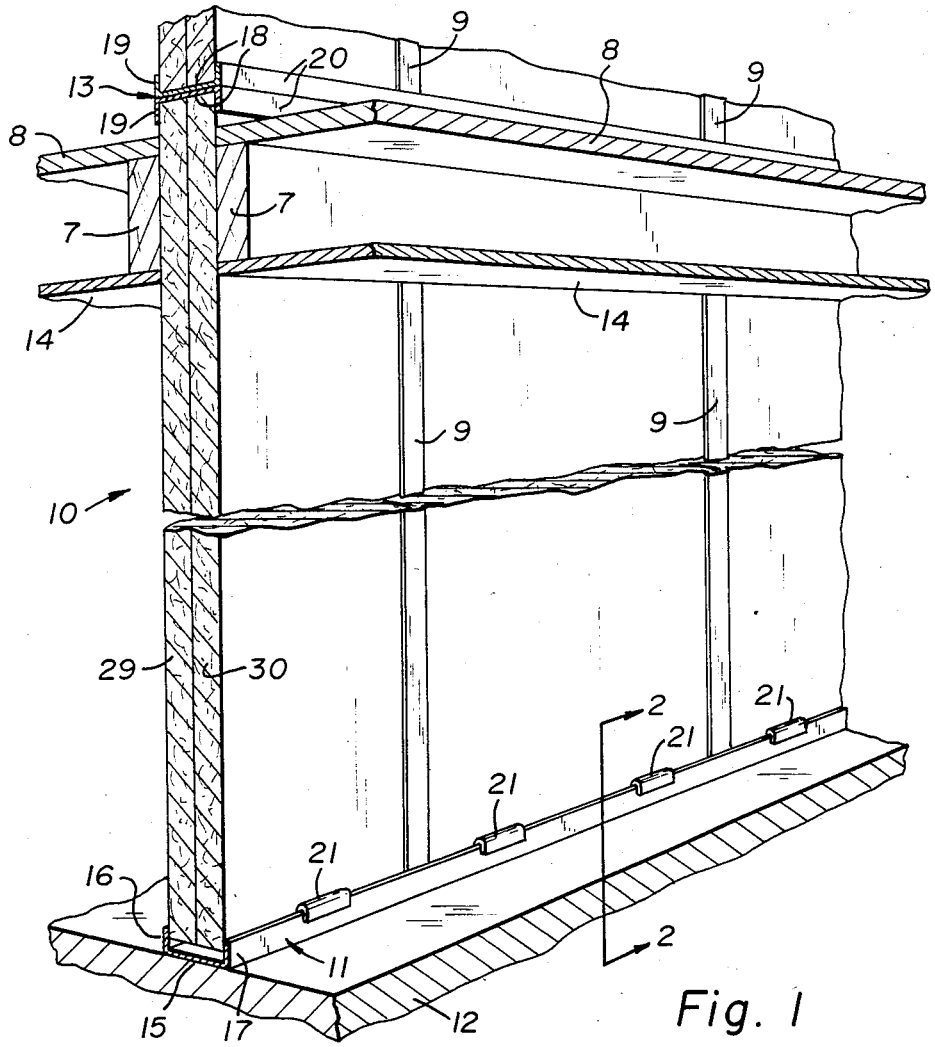
FIG. 1 is a perspective view of an area separation wall according to the invention.
Figure 2:
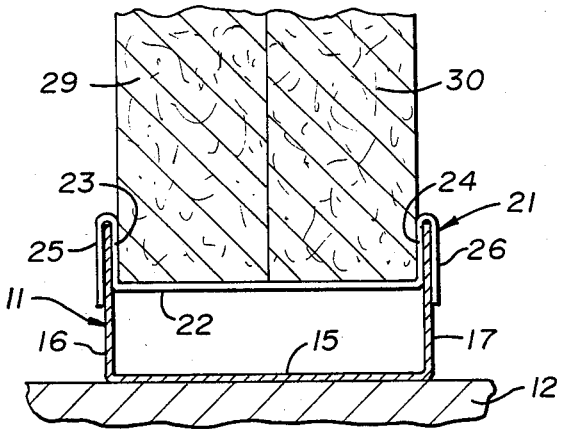
FIG. 2 is a cross-sectional view taken at the line 2—2 of FIG. 1, looking in the direction of the arrows.

Referring to FIGS. 1 and 2, an area separation wall structure 10 is shown comprising a lower runner 11 mounted on a floor 12 and an upper runner 13 comprising runner members mounted back-to-back. A ceiling 14 is mounted on joists 7, and an upper floor 8 is also supported on the joists 7. The lower runner 11 comprises a web 15 and flanges 16 and 17. The upper runner comprises webs 18 and flanges 19 and 20.

Figure 3:
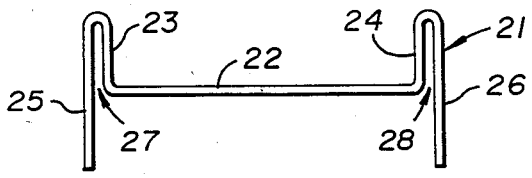
FIG. 3 is an end view of the clip according to the invention.
Figure 4:
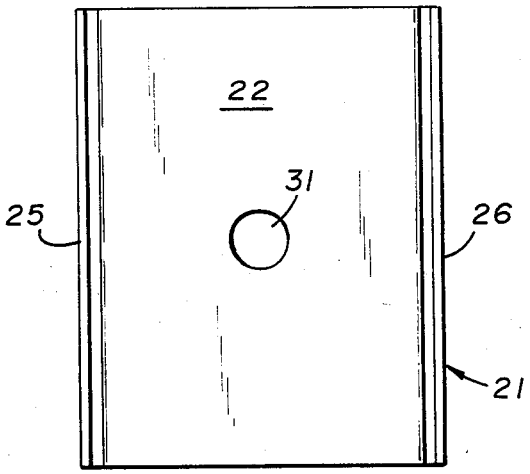
FIG. 4 is a top view of the clip shown in FIG. 3.

Referring to FIGS. 2, 3 and 4, the clip structure 21 of the present invention is shown comprising a web or platform 22, flanges 23 and 24, and return flanges 25 and 26. The flanges 23 and 24 co-operate with the return flanges 25 and 26 to define slots 27 and 28, respectively, shown in FIG. 3. As shown in FIGS. 1 and 2, gypsum wallboard panels 29 and 30 are supported on the platforms 22 of the clip 21 and spaced above the bottom or web 15 of the lower runner 11. The edges of the panels 29 and 30 are retained by studs 9. The upper edges of the wallboard panels 29 and 30 are retained within the channel of the upper runner 13. An aperture 31 is provided in the platform web 22 of the clip 21 to permit drainage of water which might collect on the surface of the platform web.

In assembling the area separation wall 10 of the present invention, the lower runner 11 is first affixed to the floor. A plurality of clips 21 are then mounted over the edges of the flanges 16 and 17 of the runner 1 . Gypsum wallboard panels 29 and 30 are then set into the channel of the runner and supported by the plat formweb 22 of the clip 21 with the edges of the panels 29 and 30 spaced above the web 15 of the lower runner 11.

During the construction of a building, when the outer walls have not been completely constructed, water tends to get into the interior of the building. Some water generally passes into the channel of the runners. If the edges of the panels rest in the water, water is absorbed in the paper cover sheets, leading to deterioration and mildew formation. However, since the edges of the panels are maintained at a distance above the web of the runner by the clip 21 of the invention, water does not come in contact with the panels and consequently does not seep into the panels which might cause such problems.

The structure of the present invention offers a number of advantages. First, the clips are very easy to mount. They maintain the panels spaced above the bottom or web of the runners and consequently keep the panel edges out of contact with any collected water. As a result, the panels do not deteriorate and are not subject to the formation of mildew. The clips are very inexpensive and easy to fabricate.

While the present invention has been disclosed in the light of specific embodiments thereof, it is evident that many alternatives, modifications, and variations may be readily apparent to one skilled in the art in the light of the foregoing disclosure as contained in the specification and drawings. Accordingly, the disclosure is intended to embrace all such alternatives, modifications and variations as may fall within the spirit and scope of the invention as defined in the following appended claims.

Invention is claimed as follows:

1. A wall structure comprising in combination:

(1) an integral U-shaped runner comprising:

(a) a web, and (b) a pair of flanges extending from the edges of said web, (2)a plurality of integral clips each comprising:

(a) a platform web, (b) a pair of flanges extending upwardly from said platform web, and (c) a pair of flanges extending downwardly from the upwardly extending flanges, said upwardly extending flanges and said downwardly extending flanges cooperating to define slots receiving the respective flanges of said runner along the entire length of said slots with the edges of said runner flanges supporting said clip, and (3) one or more wall panels having their lower edges in contact engagement with and supported by the platform web of said clips at a distance elevated above the web of said runner to prevent contact with any water which may collect in said runner.

2. A wall structure according to claim 1, wherein an aperture is provided in the platform web of said clip to permit water to drain therefrom.

3. A wall structure according to claim 1, wherein the downwardly extending flanges of said clip extend below the platform web thereof.

4. A wall structure according to claim 1, wherein said wall panels are gypsum wallboard panels.

* * * * *

UNITED STATES PATENT AND TRADEMARK OFFICE

CERTIFICATE OF CORRECTION

PATENT NO. : 4,586,305

DATED : May 6, 1986

INVENTOR(S) : Henry A. Balinski

It is certified that error appears in the above—identified patent and that said Letters Patent is hereby corrected as shown below:

Column 2, Line 39, after the word"runner"change "1" to --11--.

Signed and Sealed this

*Twelfth* Day of *August 1986*

[SEAL]

*Attest:*

DONALD J. QUIGG

*Attesting Officer*

*Commissioner of Patents and Trademarks*